US008072843B1

(12) United States Patent
Butler et al.

(10) Patent No.: US 8,072,843 B1
(45) Date of Patent: Dec. 6, 2011

(54) STEPPED MULTIPLY RESONANT WIDEBAND TRANSDUCER APPARATUS

(75) Inventors: John L. Butler, Cohasset, MA (US); Alexander L. Butler, Weymouth, MA (US)

(73) Assignee: Image Acoustics, Inc., Cohasset, MA (US)

( * ) Notice: Subject to any disclaimer, the term of this patent is extended or adjusted under 35 U.S.C. 154(b) by 422 days.

(21) Appl. No.: 12/381,991

(22) Filed: Mar. 18, 2009

(51) Int. Cl.
*H04R 17/00* (2006.01)

(52) U.S. Cl. ..... 367/158; 367/162; 367/176; 310/320; 310/323.01; 310/328

(58) Field of Classification Search ..... 367/158, 367/162, 176; 310/320, 328, 334, 336
See application file for complete search history.

(56) References Cited

U.S. PATENT DOCUMENTS

| | | | | |
|---|---|---|---|---|
| 4,332,986 | A | 6/1982 | Butler | |
| 4,604,542 | A | 8/1986 | Thompson | |
| 4,633,119 | A | 12/1986 | Thompson | |
| 4,742,499 | A | 5/1988 | Butler | |
| 4,752,918 | A | 6/1988 | Boucher et al. | |
| 4,754,441 | A | 6/1988 | Butler | |
| 4,811,307 | A | 3/1989 | Pohlenz et al. | |
| 4,845,688 | A | 7/1989 | Butler | |
| 4,864,548 | A | 9/1989 | Butler | |
| 5,047,683 | A | 9/1991 | Butler et al. | |
| 5,184,332 | A | 2/1993 | Butler | |
| 5,957,851 | A | 9/1999 | Hossack | |
| 6,734,604 | B2 | 5/2004 | Butler et al. | |
| 6,950,373 | B2 | 9/2005 | Butler et al. | |
| 7,292,503 | B2 | 11/2007 | Butler et al. | |
| 7,372,776 | B2 | 5/2008 | Butler et al. | |
| 7,453,186 | B1 | 11/2008 | Butler et al. | |
| 2002/0043897 | A1 | 4/2002 | Dunn et al. | |
| 2004/0228216 | A1 * | 11/2004 | Butler et al. | 367/158 |

* cited by examiner

*Primary Examiner* — Daniel Pihulic
(74) *Attorney, Agent, or Firm* — David M. Driscoll, Esq.

(57) ABSTRACT

An electro-mechanical transducer is disclosed, which provides a wideband response by activating successive multiple resonant frequencies in a way which provides additive output between the resonant frequencies with reduced cancellation below the first resonance and means for controlling the response by reducing the voltage drive. A multiply resonant wideband high output transducer is disclosed.

34 Claims, 5 Drawing Sheets

Fig. 3a
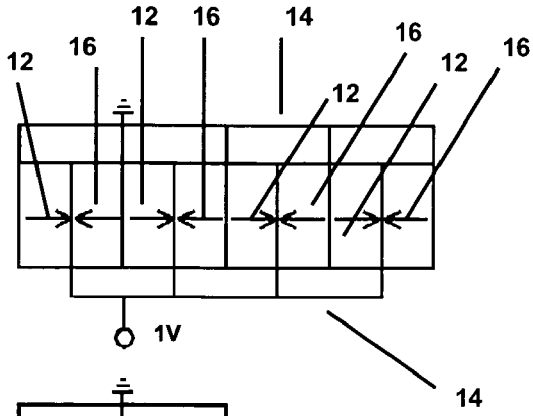
Fig. 3b
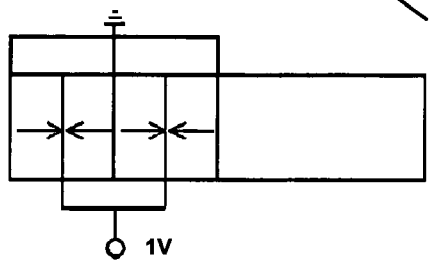
Fig. 3c
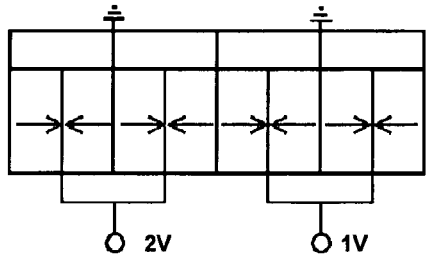
Fig. 3d
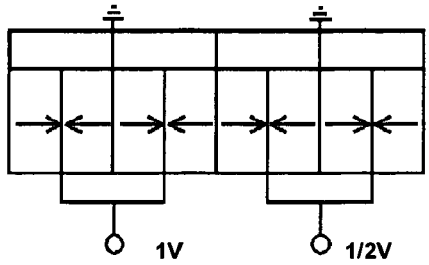
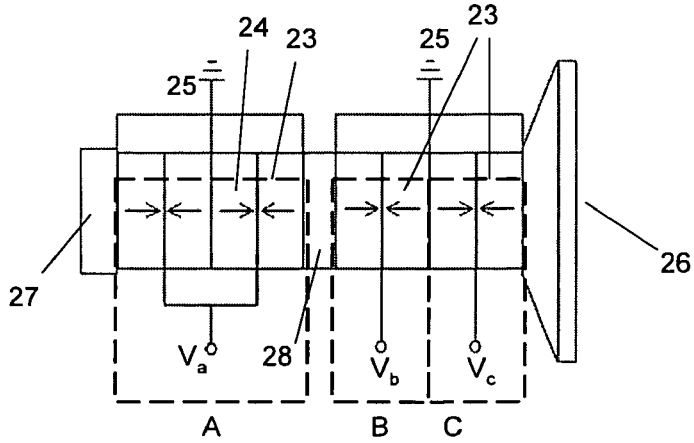
Fig. 4

STEPPED MULTIPLY RESONANT WIDEBAND TRANSDUCER APPARATUS

This invention was made with Government support under a Government contract. The Government has certain rights in the invention.

BACKGROUND OF THE INVENTION

1. Field of the Invention

The present invention relates in general to transducers, and more particularly to acoustic transducers. The present invention also relates to a transducer capable of radiating acoustic energy over a wide band of frequencies. More particularly, the present invention relates to a multiply resonant acoustic transducer with reduced cancellation below the fundamental resonance and improved output performance.

2. Background Discussion

Normally electro-acoustic underwater transducers operate in the vicinity of the fundamental resonant frequency. Maximum output is obtained at the resonant frequency; however, operation in the vicinity of this frequency limits the bandwidth of the transducer. Wideband performance can be obtained above resonance, but the band is often limited by the next overtone resonance. Because of phase shifts, the presence of this overtone resonance generally creates a cancellation between the two resonant frequencies typically resulting in a significant reduction, or notch, in the level of the response, thus limiting the bandwidth.

In our earlier invention, Butler and Butler, "Multiply Resonant Wideband Transducer Apparatus," U.S. Pat. No. 6,950,373 B2, issued on Sep. 27, 2005, a means is provided for attaining a wide bandwidth above the fundamental resonance through addition in the response between the fundamental and overtone resonant frequencies. Although the invention has been successful, output power in the vicinity of and below the fundamental resonance is limited because a significant portion of the transducer is inactive.

An object of the present invention is to provide additional electro-mechanical-drive active area that still allows the excitation of consecutive modes, but also provides greater output at and below the fundamental resonance.

Another object of the present invention is to provide a voltage stepping means for controlling the strength ratio of the symmetric and anti-symmetric modes without using feedback.

SUMMARY OF THE INVENTION

To accomplish the foregoing and other objects, features and advantages of the invention there is provided an improved electro-mechanical transduction apparatus that employs a system for utilizing the electro-mechanical driver in a way so that there is additive output between the resonant frequencies with reduced cancellation below the fundamental resonance, and thus with improved output response.

In accordance with the invention there is provided an electro-mechanical transduction apparatus that is comprised of at least two electro-mechanical drive transmission line sections. The drives are located in the transduction system so as to excite the consecutive extensional modes of vibration in a cooperative way producing an improved ultra wideband response as a projector and/or as a receiver. Other parts of the apparatus may include a piston head mass, a tail mass and possibly a compression bolt and center mass.

The drive system, such as a stack of piezoelectric ceramic (or, single crystal, electrostrictive or magnetostrictive) material, may typically take the form of extensional bars, discs, rings or cylinders. There may be a need for a permanent magnet if the magnetostrictive material is not pre-polarized or electric polarizing field for certain single crystal materials, such as PMN-28% PT, or an electrostrictive material.

The acoustic radiating piston may typically take the form of a circular, square or rectangular, flat, curved or tapered piston and would be in contact with the medium while the remaining part of the system may be enclosed in a housing to isolate these parts from the medium. An enclosure or housing may not be necessary if the system is used as an electromechanical actuator or valve. The actuator load or the piston would be connected to the point of greatest motion or force.

In one embodiment of the invention a piezoelectric stack of circular plates or rings is used to drive a piston in a load such as a water medium. The back surface of an acoustic radiating piston and the drive or tail section would normally, but not always, be enclosed by a housing, shielding this motion from the intended radiating medium, such as water or air.

Although the embodiments illustrate means for acoustic radiation from a piston, alternatively, a mechanical load can replace or be connected to the piston and in this case the transducer would be an actuator. As a reciprocal device, the transducer may be used as a transmitter or a receiver and may be used in a fluid, such as water, or in a gas, such as air.

In accordance with one embodiment of the present invention there is provided an electro-mechanical transduction apparatus that comprises: a first electrically active transduction driver section having moving ends and which supports acoustic waves; a tail section coupled to one end of the first electrically active transduction driver section; a second electrically active transduction driver section having moving ends and which also supports acoustic waves; a load coupled to one end of the second electrically active transduction driver section; means for acoustically inter-coupling the first and second electrically active transduction driver sections; and a source for exciting the transduction driver sections to cause the excitation of at least two multiple resonant frequencies including, at least one symmetrically driven odd numbered mode and one anti-symmetrically driven even numbered mode, with constructive positive addition and enhancement thereof between the multiple resonant frequencies and reduced cancellation below the lowest resonant frequency, providing enhanced output below and in the vicinity of the fundamental resonance and an extended wideband null free response from below the first resonance to at least above the second resonance.

In accordance with another aspect of the present invention there is provided a method of electro-mechanical transduction comprising the steps of: providing an electro-mechanical drive member that includes first and second electro-mechanical drive sections that are separately driven; exciting the electro-mechanical transduction member to cause the excitation of at least two multiple resonant frequencies including at least one symmetrically driven odd numbered mode and at least one anti-symmetrically driven even numbered mode. The modes are added so as to provide enhanced output below and in the vicinity of the fundamental resonance, as well as a wideband null-free response from below the first resonance to at least above the second resonance.

BRIEF DESCRIPTION OF THE DRAWINGS

Numerous other objects, features and advantages of the invention should now become apparent upon a reading of the following detailed description taken in conjunction with the accompanying drawings, in which:

FIG. 3*a* illustrates the voltage distribution for odd numbered mode symmetric excitation;

FIG. 3*b* illustrates the voltage distribution for consecutive mode excitation per FIG. 1*d;*

FIG. 3*c* illustrates the voltage distribution for an overlay of the cases of FIGS. 3*a* and 3*b;*

FIG. 3*d* illustrates the normalized stepped voltage distribution of FIG. 3*c*.

FIG. 4 illustrates a piston transducer driven by a piezoelectric stack of eight elements divided up into sections A, B and C for consecutive mode excitation for various voltage drives with an interior compression stress rod (not shown), tail mass, center mass and piston head mass for radiating sound into a medium, such a water;

DETAIL DESCRIPTION

In accordance with the present invention, there is now described herein a number of different embodiments for practicing the present invention. In the main aspect of the invention there is provided a voltage stepped longitudinal electroacoustic transducer for obtaining ultra wide bandwidth by structuring the relationship between the length and position of the drive stack and voltage distribution of the drive stack, which couples to the radiating medium through a piston.

Figure 1A:
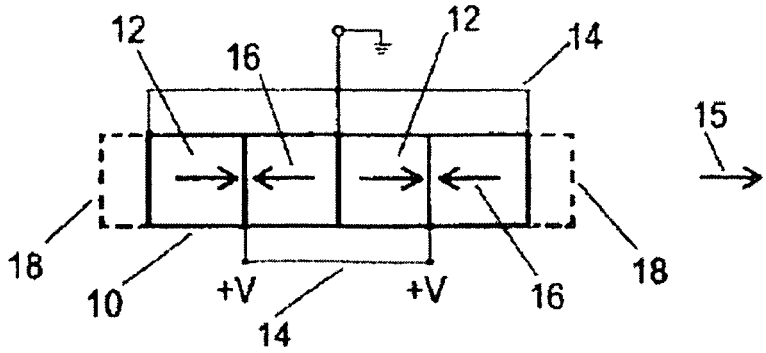
FIG. 1*a* schematically illustrates prior art of a transmission line transducer symmetrically excited by piezoelectric elements arranged for exciting odd numbered modes.

The operation of the present transducer may be understood by first referring to FIGS. 1*a* through 1*d* which illustrate the physical models and FIGS. 2*a* through 2*d* which illustrate the calculated resulting acoustic pressure amplitude. This relates to similar figures found in our U.S. Pat. No. 6,950,373. FIG. 1*a* illustrates a piezoelectric longitudinal bar resonator 10 operating in the piezoelectric 33-mode and composed of four separate piezoelectric elements 12 wired in parallel as indicated by the disclosed conductors 14 and polarized, as shown by arrows 16, for additive motion in the longitudinal direction indicated by the arrow 15 in FIG. 1*a*. The dashed lines 18 illustrate the symmetrical displacement of the bar 10 for a voltage +V.

Figure 2A:
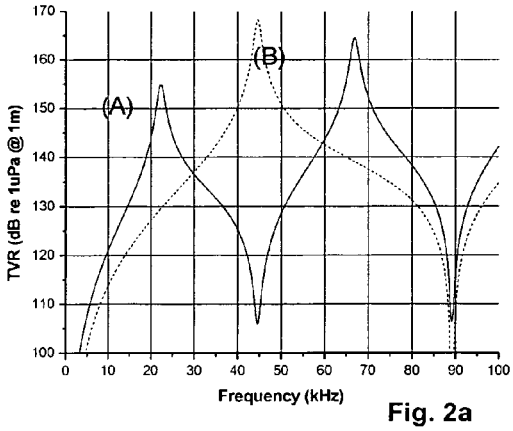
FIG. 2*a* illustrates the prior art acoustic pressure transmitting voltage response, TVR, amplitude in dB for (A) symmetrical odd numbered modes and (B) anti-symmetric even numbered modes.

The fundamental resonance occurs when the bar is one-half wavelength long and the next harmonic occurs when the bar is one wavelength long, but this cannot be excited by the voltage arrangement of FIG. 1*a*. Because of the electrical symmetry, only the first half-wavelength fundamental resonance and all the odd numbered harmonics are excited, but not the even numbered harmonics. If $f_1$ is the fundamental half wavelength resonance, then the odd numbered harmonic frequencies are $f_{2n-1}=(2n-1)f_1$ for n=1, 2, 3, . . . . The amplitude response of the acoustic pressure to the right of the bar is shown in FIG. 2*a* by the curve labeled (A) showing a fundamental resonance at 22.5 kHz and a third harmonic resonance at 67.5 kHz and a strong null at 45 kHz which is also the frequency of the second harmonic, but cannot be excited by the arrangement of FIG. 1*a*. The null at approximately 45 kHz is particularly deep because the phase of the mass controlled region of the fundamental is 180 degrees out of phase with the phase of the stiffness controlled region of the third harmonic resonant leading to a cancellation. The occurrences of these nulls limit the usefulness of such a system to provide a wide-band response. The prior art invention provides a means and method for adding a resonant response at these nulls in a constructive way using the even numbered harmonics.

Figure 1B:
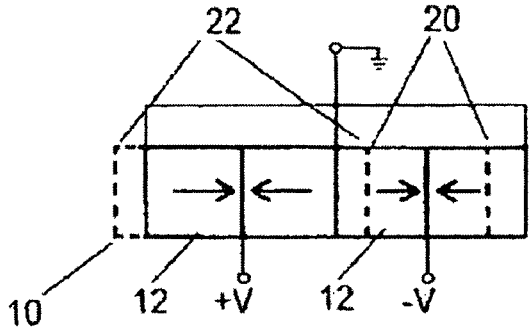
FIG. 1*b* schematically illustrates prior art transmission line transducer anti-symmetrically excited by piezoelectric elements arranged for exciting even numbered modes.
Figure 2B:
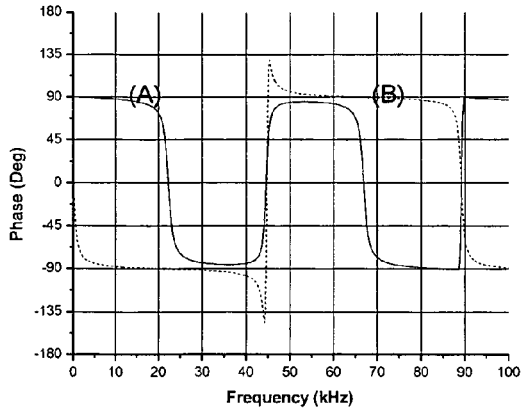
FIG. 2*b* illustrates the prior art acoustic phase transmitting response associated with the TVR for (A) symmetrical odd numbered modes and (B) anti-symmetric even numbered modes illustrated in FIG. 2*a;*

The even numbered harmonics (but not the odd numbered) are excited by the anti-symmetric voltage arrangement of FIG. 1*b* where the polarity of the voltage, V, on the right hand pair of elements is reversed. This causes a contraction on the right element pair while the left element pair expands. This is illustrated in FIG. 1*b* by the respective ranges 20 and 22. The excited even numbered harmonic resonances are given by $f_{2n}=(2n)f_1$ for n=1, 2, 3, . . . . The first even numbered harmonic acoustic pressure amplitude response is plotted as curve (B) in FIG. 2*a* and seen to resonate at approximately 45 kHz which is just the location of the null for the wiring arrangement of FIG. 1*a*. The even numbered harmonic motion on the right side of the bar is 180 degrees out of phase with the first odd numbered harmonic mode as may readily be seen by comparing the displacements at 18 of FIG. 1*a* with the displacements at range 20 of FIG. 1*b*. The corresponding phase response is illustrated in FIG. 2*b* showing the out of phase nature at low and high frequencies but in-phase motion at mid frequencies from 30 kHz to 60 kHz. It is because of the additional phase shift of FIGS. 1*a* and 1*b* that yields the ultimate in-phase condition at mid band which allows the constructive addition of the even numbered harmonics of FIG. 1*b* to the odd numbered harmonics of FIG. 1*a* if the two systems are added.

Figure 1C:
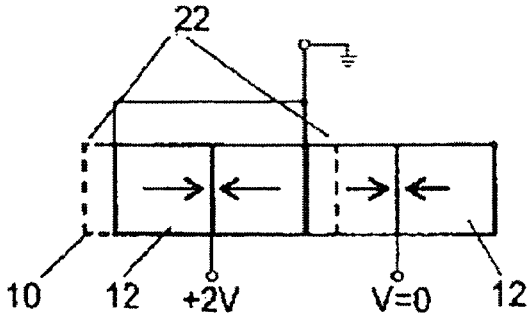
FIG. 1*c* schematically illustrates prior art of a transmission line transducer asymmetrically excited by piezoelectric elements arranged for exciting both odd and even number modes of vibration with zero voltage applied to one-half of the active material.
Figure 1D:
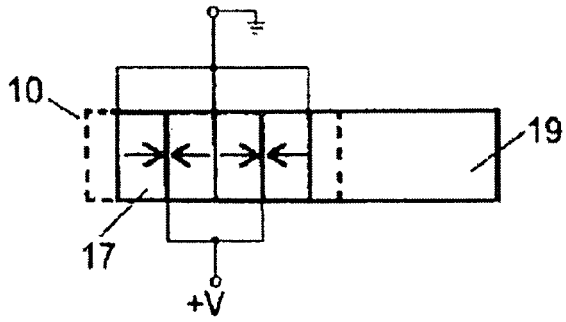
FIG. 1*d* schematically illustrates prior art of a transmission line transducer asymmetrically excited by piezoelectric elements arranged for exciting both odd and even number modes of vibration where the zero voltage section of FIG. 1*c* has been replaced by an electrically inactive transmission line.
Figure 2C:
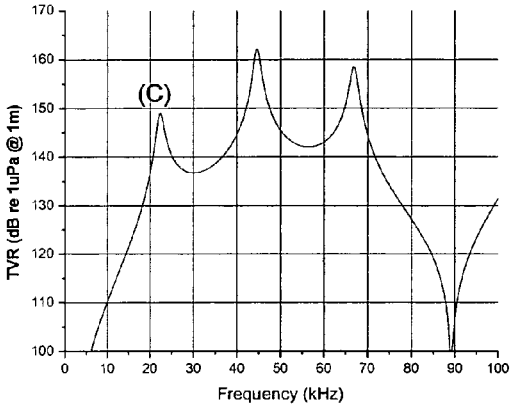
FIG. 2*c* illustrates the acoustic pressure transmitting voltage response, TVR, amplitude in dB for (C) asymmetric drive resulting in both odd and even number modes of vibration.
Figure 2D:
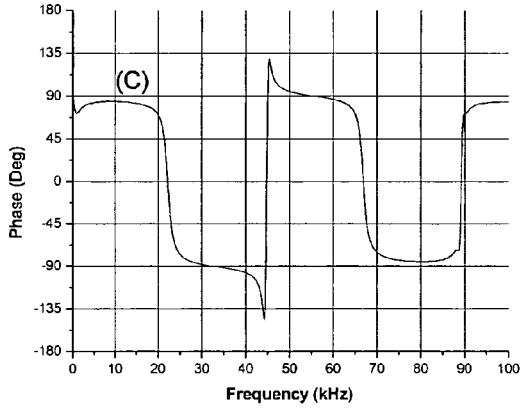
FIG. 2*d* illustrates the acoustic phase transmitting response associated with FIG. 2*c* for (C) asymmetric drive resulting in both odd and even number modes of vibration.

The sum of the voltage conditions of FIGS. 1*a* and 1*b* leads to the condition illustrated in FIG. 1*c* showing 2V volts on the left piezoelectric pair and 0 volts on the right piezoelectric pair. Since the V=0 voltage drive section is no longer active in generating a displacement it may be replaced by the electrically inactive transmission line section 19 as shown in FIG. 1*d*. Also shown in FIG. 1*d* is a reconfigured drive section with elements 17 of half thickness for the same strain as FIG. 1*c* but with 1 volt drive as in FIGS. 1*a* and 1*b*. The wideband acoustic pressure amplitude response for the cases of FIG. 1*c* or 1*d* are given in FIG. 2*c* showing the addition of the even harmonic resonance at 45 kHz filling in the original null with no nulls between the resonances as desired. The resulting phase response, shown in FIG. 2*d*, is a selective result of the two phase curves of FIG. 2*b* as determined by the amplitude of the corresponding harmonic response of FIG. 2*c*. The harmonic frequencies for this case are $f_n=(n)\ f_1$ for n=1, 2, 3, . . . . The first null now appears in the vicinity of 90 kHz at twice the frequency of the 45 kHz null for the original case of FIG. 1*a* and thus doubling the bandwidth. This null occurs when the left hand piezoelectric pair is one wavelength long. The transducer now resonates in its fundamental mode, its second harmonic mode and its third harmonic mode. The bandwidth can be increased by reducing the proportional length of the active piezoelectric section allowing the excitation of higher harmonic modes such as the fourth, fifth and sixth modes, thus allowing an ultra wide bandwidth.

This prior art invention, as described in our '373 patent, provides a means for the addition of both odd and even modes yielding a wideband response of multiple resonances without destructive interference which would result in nulls. Each mode has an associated electromechanical coupling coefficient allowing a distribution of coupling over the frequency band, improving the wideband effective electromechanical coupling coefficient of the transducer. This description shows an ideal case where there is no piston on the radiating side of the transducer nor is there a tail mass, center mass or compression rod as there might be in a practical transducer. These additions would affect the modal excitation and the "harmonic frequencies" would not be exact integer multiples. Moreover, because of a possible lack of mechanical symmetry some odd modes could be excited by even mode drive and some even modes could be excited by odd mode drive.

Although the prior art invention yields consecutive mode excitation, it yields greater output at the even numbered modes and reduced output below the fundamental resonance of the first odd numbered mode. The '373 patent also shows a feedback means for reducing the output of the first numbered even mode but does not address the reduced output below the fundamental resonance. This reduction can be seen at 10 kHz by comparing the 110 dB level of FIG. 2*c* with the 120 dB and 114 dB levels of curves (A) and (B) of FIG. 2*a*. The 10 dB reduction between curves (A) and (C) are a result of the out-of-phase response between curves (A) and (B) causing a cancellation between the two, leading to a reduced output of curve (C) at frequencies in the vicinity of and below the fundamental resonance of the first odd numbered mode. Now, in accordance with the present invention there is provided a means to increase the output in this region by reducing the cancellation below the fundamental mode.

The essence of the present invention may be appreciated by considering the addition of the cases illustrated in FIGS. 1*a* and 1*d* with corresponding response and phase curves (A) and (C) of respective FIGS. 2*a*, 2*b* and 2*c*, 2*d*. It is noted from the phase curves of FIGS. 2*b* and 2*d* that the phase below the first resonance is the same for the cases of FIGS. 1*a* and 1*d* with response curves (A) and (C) of FIGS. 2*a* and 2*c*. Thus, the addition of these two cases should lead to an increase in output in the vicinity of and below the fundamental resonance and also fill in of the notch of curve (B) of FIG. 2*a*. With the same polarization arrow notation of FIG. 1*a*, the steps are illustrated in FIGS. 3*a* through 3*d* where the response curve (A) of FIG. 2*a* corresponds to response of FIG. 3*a* and the response curve (C) of FIG. 2*c* corresponds to the response of FIG. 3*b*. The overlay sum of these two cases corresponds to the voltage stepped distribution of FIG. 3*c* and the normalized stepped distribution of FIG. 3*d* which is an example of the present invention. Other stepped distributions may be used to control the addition of the level between the resonances and below the fundamental resonance.

FIG. 4 represents the present teachings and allows the addition and coexistence or both symmetric driven odd numbered modes ($V_a=V_b=V_c$) and anti-symmetric driven even numbered modes ($V_a=-V_b=-V_c$) in proportions that reduces the larger response of the first even numbered mode illustrated by curve (B) of FIG. 2*a* and provides a reduction in the low frequency cancellation resulting in a greater output at frequencies at or below the fundamental resonance. FIG. 4 illustrates a piezoelectric stack A composed of four elements 23 along with sections B and C composed of pairs of elements 23. The arrows, 24, show the direction of polarization such that an applied positive potential, relative to ground, 25, causes an expansion. This expansion (and contraction with a voltage potential reversal) causes the piston, 26, to radiate into the medium such as water or air. The transducer may also have a tail mass, 27, and a center mass, 28, for response modification or the attachment of an interior compressive tie rod. Voltages $V_a$, $V_b$, and $V_c$ are applied to respective sections A, B and C relative to ground 25.

Figure 5:
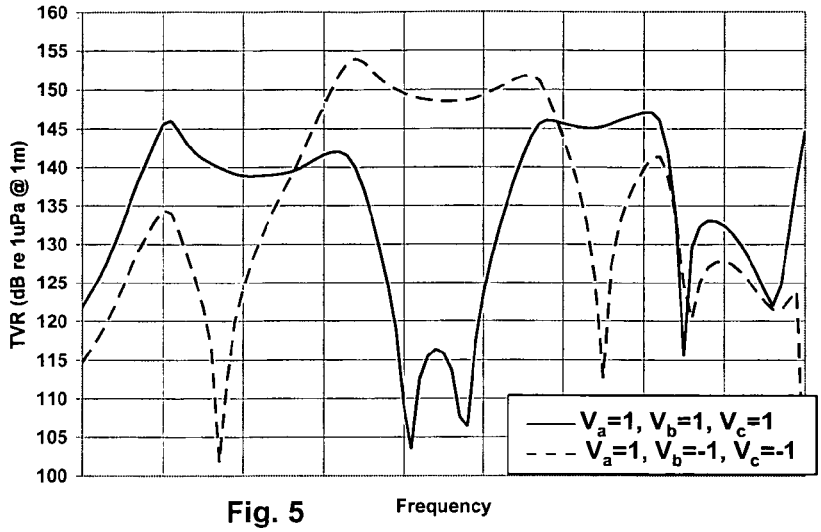
FIG. 5 illustrates the piston in-water transmitting voltage pressure response, TVR, for symmetric voltages $V_a=1$, $V_b=1$, $V_c=1$ and anti-symmetric voltages $V_a=1$, $V_b=-1$, $V_c=-1$ applied to the piezoelectric stack of FIG. 4.
Figure 6:
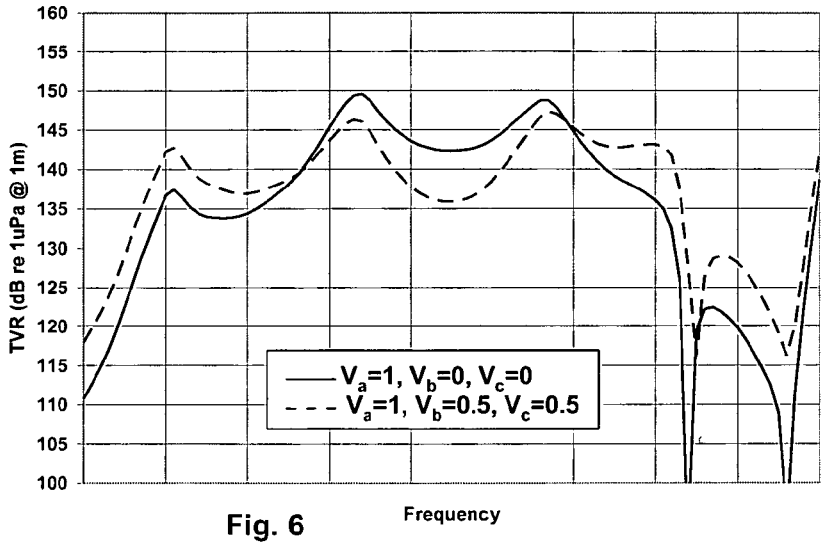
FIG. 6 illustrates the piston in-water transmitting voltage pressure response for prior art voltages $V_a=1$, $V_b=0$, $V_c=0$ and present invention voltages $V_a=1$, $V_b=½$, $V_c=½$ applied to the piezoelectric stack.
Figure 7:
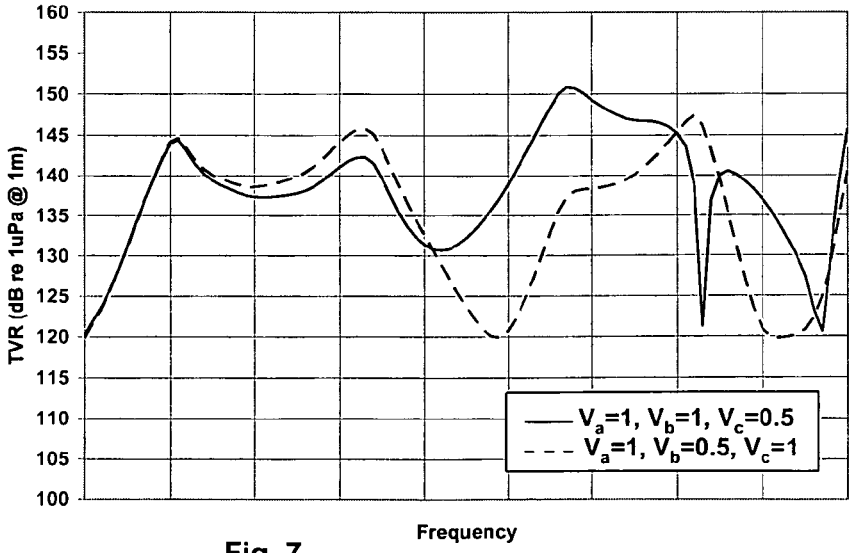
FIG. 7 illustrates the piston in-water transmitting voltage pressure response for the present invention voltages $V_a=1$, $V_b=1$, $V_c=½$ and $V_a=1$, $V_b=½$, $V_c=1$ applied to the piezoelectric stack.

FIGS. 5 through 7 illustrate finite element computed responses for the transducer of FIG. 4 showing results of the prior art and some examples of the present invention allowing a direct comparison of the performance. The solid line of FIG. 5 shows the classical even symmetry drive for voltages $V_a=V_b=V_c=1$ while the dashed line shows the results for anti-symmetric drive with $V_a=1$, $V_b=-1$ and $V_c=-1$. As may be seen, these results are not as well defined as curves (A) and (B) of FIG. 2*a*, but they do show a mid-band null for symmetrical drive and mid band high output response for the anti-symmetric drive. The combination of these two drive cases yields the prior art solid line response of FIG. 6 for $V_a=1$, $V_b=0$ and $V_c=0$. The dashed line in FIG. 6 shows the improved response of the present invention with $V_a=1$, $V_b=½$ and $V_c=½$ where a smaller proportion of the anti-symmetric drive mode is added to the symmetric drive mode solid-line-curve of FIG. 5. It is seen that with the present invention there is 8 dB greater acoustic output at the lowest frequency, 5 dB greater output at the fundamental frequency and better proportioned response over the more than a two octave band limited by the first null. The voltages $V_a$ and $V_b$ may be distributed to tailor the response in other ways such as illustrated in FIG. 7 with $V_a=1$, $V_b=1$ and $V_c=½$ for the solid curve and $V_a=1$, $V_b-=½$ and $V_c=1$ for the dashed curve. In these two cases the voltage stepping is on only one half of the four elements of the section behind or coupled with the piston. These two cases yield 2 dB greater output at the lowest frequency than the dashed line curve ($V_a=1$, $V_b=½$ and $V_c=½$) of FIG. 6, but with a reduced level mid-band response.

Figure 8A:
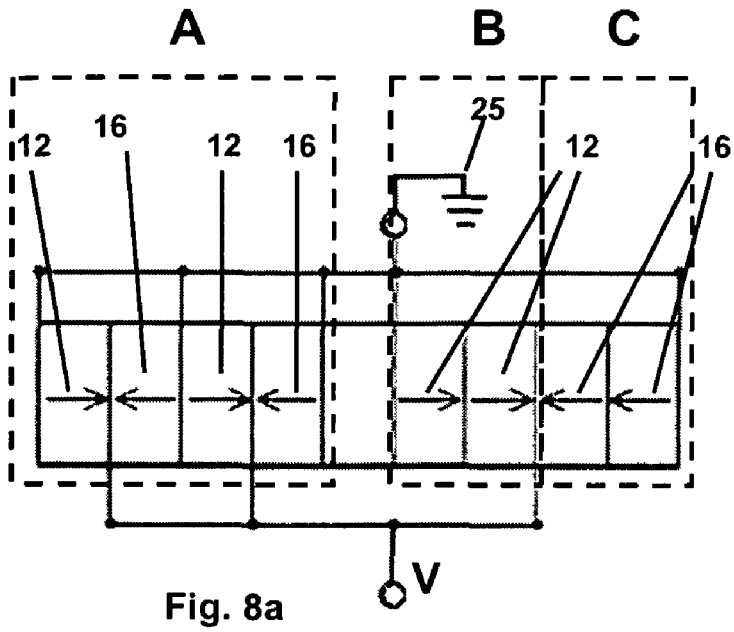
FIG. 8*a* illustrates a wiring arrangement for $V_a=1$, $V_b=½$ and $V_c=½$.
Figure 8B:
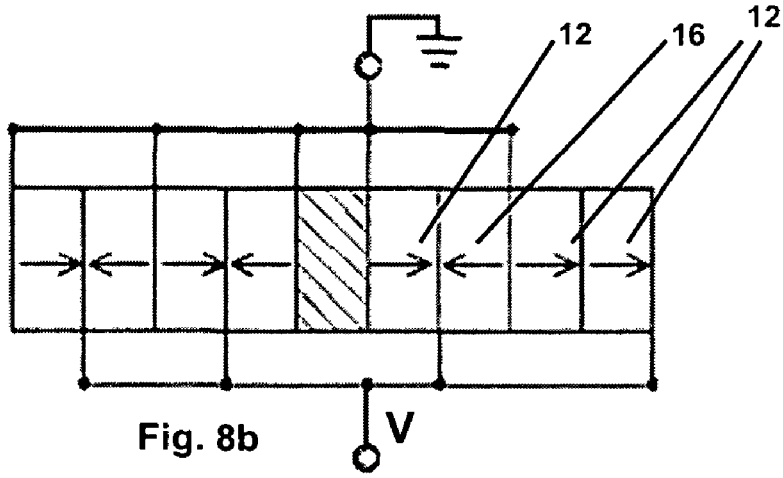
FIG. 8*b* illustrates a wiring arrangement for $V_a=1$, $V_b=1$ and $V_c=½$.
Figure 8C:
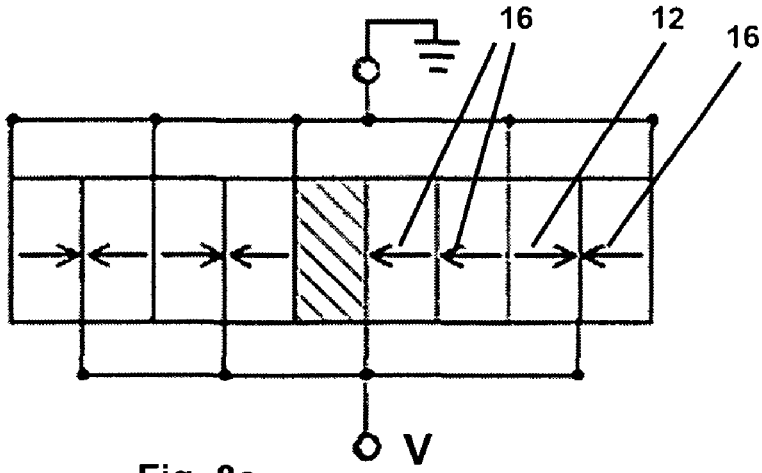
FIG. 8*c* illustrates a wiring arrangement for $V_a=1$, $V_b=½$ and $V_c=1$.

The dashed response of FIG. 6 may be further altered by adjusting the stepped voltages in the range $0<V_b=½<1$, while the responses of FIG. 7 may also be modified for values $0<V_b<1$ and $0<V_c<1$. This range of values may be obtained by the use of three amplifiers or a transformer with three taps. A gradual voltage step distribution may be also obtained with multiple amplifiers or a transformer with multiple taps. The one-half voltage stepping cases, illustrated in FIGS. 6 and 7 are particularly convenient and can be applied by direct wiring without the need for multiple amplifiers or taped transformers. These examples are shown in FIGS. 8*a*, 8*b* and 8*c*. In the notation of FIGS. 3*a* and 4, FIG. 8*a* yields the voltage distribution $V_a=1$, $V_b=½$, $V_c=½$, FIG. 8*b* yields the voltage distribution $V_a=1$, $V_b=1$, $V_c=½$, and FIG. 8*c* yields the voltage distribution $V_a=1$, $V_b=½$, $V_c=1$, with corresponding TVR response given in FIGS. 6 and 7, respectively. The key to this particular wiring arrangement is that two elements, positioned in series, with polarization in the same direaction, yields a voltage reduction of ½. Refer to FIG. 8*a*, for example, and the same direction polarization in sections B and C. More general wiring arrangements and voltage stepping may be obtained by the use of more elements and also by elements of different thickness. This could provide nearly continuous stepping of the voltage allowing excitation of all consecutive modes with response equalization and improved low frequency response.

The above principles of this invention may be applied to transducers which transmit or receive acoustic waves or to electro mechanical actuators with the load attached to the piston. Moreover, the electromechanical transduction materials may be single crystal material, piezoelectric, electrostrictive or magnetostrictive, where in the latter case the number of coil turns would be stepped. Common electromechanical transduction materials such as PZT, PMN-PT, terfenol-D and galfenol could be used with this invention.

Having now described a limited number of embodiments of the present invention, it should now become apparent to those skilled in the art that numerous other embodiments and modifications thereof are contemplated as falling within the scope of the present invention as defined in the appended claims.

What is claimed is:

1. An electro-mechanical transduction apparatus comprising:

a first electrically active transduction driver section having moving ends and which supports acoustic waves;

a tail section coupled to one end of the first electrically active transduction driver section;

a second electrically active transduction driver section having moving ends and which also supports acoustic waves;

a load coupled to one end of the second electrically active transduction driver section;

means for acoustically inter-coupling the first and second electrically active transduction driver sections;

and a source for exciting said transduction driver sections to cause the excitation of at least two multiple resonant frequencies including, at least one symmetrically driven odd numbered mode and one anti-symmetrically driven even numbered mode, with constructive positive addition and enhancement thereof between the multiple resonant frequencies and reduced cancellation below the lowest resonant frequency, providing enhanced output below and in the vicinity of the fundamental resonance and an extended wideband null free response from below the first resonance to at least above the second resonance.

2. An electro-mechanical transduction apparatus as set forth in claim 1 wherein there are three multiple resonant frequencies without nulls between the frequencies with a wideband response from below the first resonance to just above the third resonance.

3. An electro-mechanical transduction apparatus as set forth in claim 1 wherein the first electrically active transduction driver section is driven with voltage $V_1$ and the second electrically active transduction driver section is driven with voltage $V_2$ where $0<(V_2/V_1)<1$ providing enhanced low frequency output greater than with $V_2=0$ and greater mid-band performance than $V_2=V_1$.

4. An electro-mechanical transduction apparatus as set forth in claim 3 wherein the ratio $V_2/V_1$ is approximately equal to one-half.

5. An electro-mechanical transduction apparatus as set forth in claim 1 wherein the second electrically driven transduction driver section includes one portion that is driven less than another portion thereof.

6. An electro-mechanical transduction apparatus as set forth in claim 1 wherein the second electrically active transduction driver section includes one portion that is driven at approximately one-half the drive of another portion thereof.

7. An electro-mechanical transduction apparatus as set forth in claim 1 wherein the second electrically active transduction driver section is driven less than the first electrically active transduction driver section by means of multiple amplifiers or multiple taped transformer.

8. An electro-mechanical transduction apparatus as set forth in claim 1 wherein the second electrically active transduction driver section is driven less by use of different thickness piezoelectric elements.

9. An electro-mechanical transduction apparatus as set forth in claim 1 wherein the second electrically active transduction driver section is driven less than the first electrically active transduction driver section by means of series-parallel wiring of the elements.

10. An electro-mechanical transduction apparatus as set forth in claim 1 wherein the multiple resonant frequencies are approximately related to the fundamental resonance by successive integer multiples.

11. An electro-mechanical transduction apparatus as set forth in claim 1 wherein the load is in the form of an acoustic radiating piston and medium that supports acoustic waves.

12. An electro-mechanical transduction apparatus as set forth in claim 1 wherein the driver sections include electromechanical drive means that is at least one of piezoelectric ceramic, piezoelectric, electrostrictive, single crystal, magnetostrictive or other electro-mechanical drive material or transduction system.

13. An electro-mechanical transduction apparatus as set forth in claim 12 wherein the electromechanical transduction drive means is in the form of plates, bars, rings or a cylinder operated in the 33 or 31 mode.

14. An electro-mechanical transduction apparatus as set forth in claim 1, which is compliantly mounted from a front, back or intermediate location near the interface between the electromechanical drive and the transmission line.

15. An electro-mechanical transduction apparatus as set forth in claim 1 wherein the load is a fluid or a mechanical device or optical device and the apparatus is an actuator.

16. An electro-mechanical transduction apparatus as set forth in claim 12 including a compression bolt used to compress the electromechanical drive means.

17. An electro-mechanical transduction apparatus comprising:

an electrically controlled transduction driver having moving ends;

said transduction driver including first and second electromechanical drive sections;

a tail section coupled to the first drive section of the transduction driver;

a load coupled to and driven by the second drive section; and a source for exciting said transduction driver by separately controlling the first and second drive sections so as to cause the excitation of at least two multiple resonant frequencies including at least one symmetrically driven odd numbered mode and at least one anti-symmetrically driven even numbered mode, said modes added so as to provide enhanced output below and in the vicinity of the fundamental resonance and a wideband null-free response from below the first resonance to at least above the second resonance.

18. An electro-mechanical transduction apparatus as set forth in claim 17 wherein the first drive section is driven with voltage $V_1$ and the second drive section is driven with voltage $V_2$ where $0<(V_2/V_1)<1$ providing enhanced low frequency output greater than with $V_2=0$ and greater mid-band performance than $V_2=V_1$.

19. An electro-mechanical transduction apparatus as set forth in claim 18 wherein the ratio $V_2/V_1$ is approximately equal to one-half.

20. An electro-mechanical transduction apparatus as set forth in claim 17 wherein the second drive section includes one portion that is driven less than another portion thereof.

21. An electro-mechanical transduction apparatus as set forth in claim 17 wherein the second drive section includes one portion that is driven at approximately one-half the drive of another portion thereof.

22. An electro-mechanical transduction apparatus as set forth in claim 17 wherein the second drive section includes two drive portions that each include two transduction elements, positioned in series, with polarization in the same direction of at least one of said portions.

23. An electro-mechanical transduction apparatus as set forth in claim 22 wherein both of the drive portions have elements that are positioned in series, with polarization in the same direction.

24. An electro-mechanical transduction apparatus as set forth in claim 17 wherein the transduction driver is in the form of plates, bars, rings or a cylinder operated in the 33 or 31 mode.

25. An electro-mechanical transduction apparatus as set forth in claim 17 wherein the load is in the form of an acoustic radiating piston and medium that supports acoustic waves.

26. A method of electro-mechanical transduction comprising the steps of: providing an electro-mechanical drive member that includes first and second electro-mechanical drive sections that are separately driven; exciting said electro-mechanical transduction member to cause the excitation of at least two multiple resonant frequencies including at least one symmetrically driven odd numbered mode and at least one anti-symmetrically driven even numbered mode, said modes added so as to provide enhanced output below and in the vicinity of the fundamental resonance and a wideband null-free response from below the first resonance to at least above the second resonance.

27. A method as set forth in claim 26 wherein the first drive section is driven with voltage $V_1$ and the second drive section is driven with voltage $V_2$ where $0<(V_2/V_1)<1$ providing enhanced low frequency output greater than with $V_2=0$ and greater mid-band performance than $V_2=V_1$.

28. A method as set forth in claim 27 wherein the ratio $V_2/V_1$ is approximately equal to one-hall.

29. A method as set forth in claim 26 wherein one portion of the second drive section is driven less than another portion thereof.

30. A method as set forth in claim 26 wherein one portion of the second drive section is driven at approximately one-half the drive of another portion thereof.

31. A method as set forth in claim 26 wherein the second drive section includes two drive portions that each include two transduction elements, positioned in series, with polarization in the same direction of at least one of said portions.

32. A method as set forth in claim 31 wherein both of the drive portions have elements that are positioned in series, with polarization in the same direction.

33. A method as set forth in claim 26 wherein the electro-mechanical drive member is in the form of plates, bars, rings or a cylinder operated in the 33 or 31 mode.

34. A method as set forth in claim 26 including a load in the form of an acoustic radiating piston and medium that supports acoustic waves.

* * * * *